United States Patent [19]

Dashew

[11] 4,148,852

[45] Apr. 10, 1979

[54] METHOD AND APPARATUS FOR PROGRESSIVE MOLDING OF BUILDINGS

[75] Inventor: Stephen S. Dashew, Palos Verdes Estates, Calif.

[73] Assignee: La Mesa Industries, Inc., Compton, Calif.

[21] Appl. No.: 454,100

[22] Filed: Mar. 25, 1974

[51] Int. Cl.[2] ..... E04G 11/56

[52] U.S. Cl. ..... 264/33; 249/18; 249/20; 249/210; 264/34

[58] Field of Search ..... 249/18–20, 249/28–32, 210, 13, 26–27; 425/62–63; 264/31, 33–34; 52/637–638; 182/179, 152; 14/14; 403/58

[56] References Cited

U.S. PATENT DOCUMENTS

| | | | |
|---|---|---|---|
| 1,498,665 | 6/1924 | MacIvor | 249/210 |
| 2,027,499 | 1/1936 | Tully | 403/58 |
| 2,353,039 | 7/1944 | Janiszewski | 14/14 |
| 2,591,624 | 4/1952 | Siebels | 403/58 |
| 2,616,648 | 11/1952 | Budreck | 403/58 |
| 2,811,349 | 10/1957 | Bondurant et al. | 403/58 |
| 3,414,228 | 12/1968 | Jennings | 249/18 |
| 3,450,280 | 6/1969 | Colnot | 264/34 |
| 3,628,765 | 12/1971 | Sanders | 249/19 |

FOREIGN PATENT DOCUMENTS

| | | | |
|---|---|---|---|
| 996810 | 12/1951 | France | 249/19 |

*Primary Examiner*—Roy Lake
*Assistant Examiner*—John McQuade
*Attorney, Agent, or Firm*—Freilich, Hornbaker, Wasserman, Rosen & Fernandez

[57] ABSTRACT

A structure for supporting floor-molding forms in a multi-story building, including a truss that supports the forms and four telescoping leg units with upper ends pivotally connected to the truss, for supporting the entire weight of the truss on the previously-cast floor. The leg units are pivoted and telescoped out until the lower end of each leg unit lies on an area of the floor which is adjacent to a column or load-bearing wall of the building, within the 45° shear plane lying about the column or wall, so that the weight of the truss and load thereon is transferred directly to the columns or walls to thereby eliminate heavy loading of the already-formed floor.

10 Claims, 6 Drawing Figures

METHOD AND APPARATUS FOR PROGRESSIVE MOLDING OF BUILDINGS

BACKGROUND OF THE INVENTION

This invention relates to shoring methods and apparatus for supporting concrete forms, and more particularly to shoring of floor-forming forms in a multi-story building.

Multi-story buildings are often constructed by erecting a group of columns that are intended to support the weight of the floors. The concrete floors are then poured and partially hardened. In order to pour concrete for each new floor, shoring must be set up to support the forms at the desired height above the next lower floor. This is commonly accomplished by positioning a truss over the already-formed floor, placing stringer beams or stringers on top of the truss, and mounting the concrete forms on the stringers. The truss is commonly supported on the already-formed floor by numerous legs that extend vertically from the truss to the floor. One of the problems encountered in this shoring procedure is that the concrete floor on which the supporting legs rest may be only partially hardened and therefore may not be capable of reliably supporting the weight of the shoring and concrete to be poured. Accordingly, contractors often must brace the leg-supporting floor by reshoring, which includes establishing shoring under the floor to transfer some of the weight to lower floors. The reshoring procedure can involve considerable manpower and therefore can greatly increase the cost of construction. Instead of supporting the truss on vertically-extending legs, it is possible to support them on beams whose ends are fastened to columns of the building, in those cases where the columns are closely spaced. However, this requires that beam-supporting brackets be attached to the columns, which can be costly, and that the columns be patched up after such brackets have been removed.

SUMMARY OF THE INVENTION

In accordance with one embodiment of the present invention, a shoring structure is provided for supporting floor-molding forms above a previously-formed floor of a multi-story building, without requiring reshoring of the previously-formed floor or the attachment of special brackets to the columns. The apparatus includes a truss assembly for supporting the concrete forms and four diagonal leg units that extend between the truss and the floor. The leg units extend diagonally to areas of the previously-formed floor which lie adjacent to columns of the building, the lower ends of the leg units lying within the 45° shear plane which extends around each corresponding column. As a result, the weight of the truss and of the poured concrete thereon is transmitted substantially directly to the columns, without loading the previously-formed floor in bending. This can eliminate the need to reshore the previously-formed floor.

Each of the leg units includes a hollow upper leg member and a lower leg member that telescopes within the upper one. The top of the upper leg member is pivotally connected to the top of the truss, while the bottom of the upper leg member is braced by adjustable straps to the lower end of the truss. The pivotal mounting of the leg units and their telescoping capability, allows each leg unit to be adjusted so that its lower end can lie adjacent to a column while the truss assembly lies at any chosen position and height within a wide range. After each use of the truss assembly, it can be moved as a unit to the next floor, by supporting the truss on rollers and compacting the leg units. The leg units can be pivoted towards the vertical so that they lie close to the truss to readily clear the columns, and the leg units can be telescoped to a minimum length to permit rolling of the truss on rollers of small height.

The novel features that are considered characteristic of this invention are set forth with particularity in the appended claims. The invention will best be understood from the following description when read in connection with the accompanying drawings.

DESCRIPTION OF THE PREFERRED EMBODIMENTS

Figure 1:
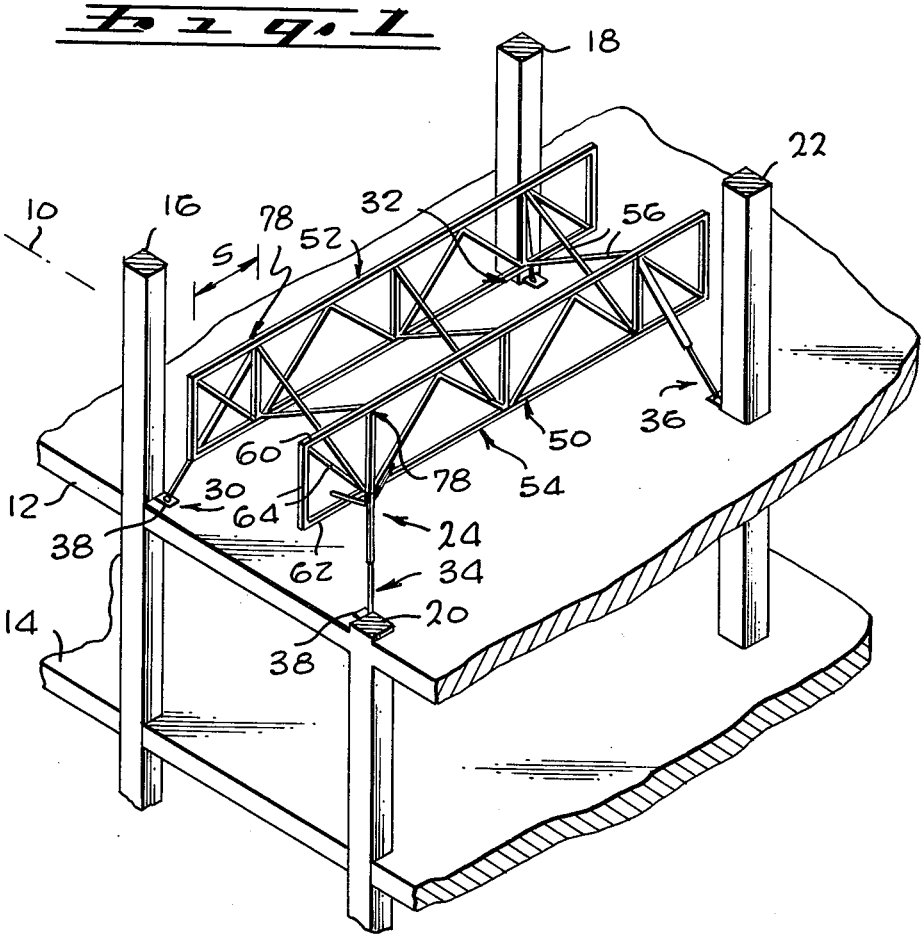
FIG. 1 is a perspective view showing a portion of a multi-story building and the truss assembly of the invention in place thereon.
Figure 5:
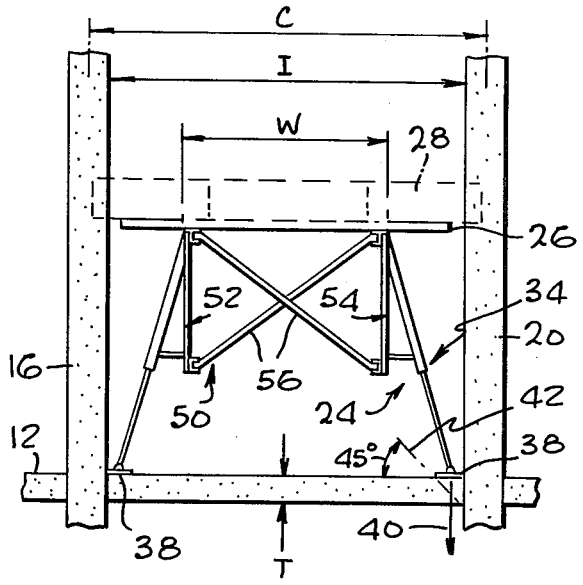
FIG. 5 is a front elevation view of the building and truss of FIG. 1, but with stringers and forms in place thereon.
Figure 6:
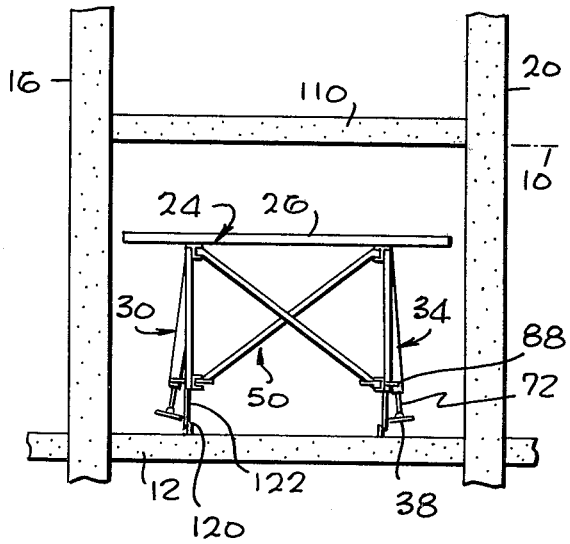
FIG. 6 is a view similar to FIG. 5, but showing the manner in which the truss assembly is compacted and moved out of the building after it has been used to form a concrete floor.

FIG. 1 illustrates a portion of a concrete forming system for forming a floor at a height indicated by line 10 in a multi-story building. The building has additional floors 12, 14 lying below the level of the floor to be formed, and the weight of all of the floors is supported by a group of columns, four of which are shown at 16, 18, 20, and 22. The forming system includes a truss assembly 24 that supports numerous horizontal beams, or stringers 26 (FIG. 5) that, in turn, support concrete forms 28 upon which concrete is poured to form the next higher floor. Thus, the considerable weight of the poured concrete, as well as the weight of the forms and stringers are borne by the truss assembly 24, an important problem that arises in this type of concrete construction is the problem of how to support the weight of the truss assembly 24 or any other type of shoring that can be used. If the truss assembly 24 had only vertical legs extending to many points along the previously formed floor 12, as commonly practiced in the prior art, then the load would have to be borne by the floor 12. This has generally required reshoring of the floor 12 on the floor 14 below it, as well as reshoring of the floor 14 on the one below it. Reshoring requires the installation of posts between the lower floors, which involves substantial labor and expense. An alternative of supporting a truss assembly directly on the columns 16–22 has previously involved the mounting of brackets on the columns and the subsequent removal of the brackets and patching of the columns, all of which also involves considerable expense.

In accordance with the present invention, the truss assembly 24 is provided with leg units 30, 32, 34, and 36, which support the rest of the truss assembly and the load thereon in a manner that eliminates the need for reshoring while also eliminating the need for any special brackets or the like on the columns. This is accomplished by constructing the leg units so that each of them can be oriented diagonally (away from the vertical) with its lower end 38 lying on the previously-formed floor 12 at a location adjacent to one of the columns 16–22. In particular, the middle of the leg unit bottom 38, and therefore the center of the load transferred from the leg unit 34 to the floor 12, as indicated by arrow 40 (FIG. 5), lies within the 45° shear plane indicated by an imaginary line 42 extending from the column 20.

It is well known in mechanics that a compressive load applied to the top of a thick plate is distributed over an increasing area at progressively greater depths of the plate. A distribution angle of 45° is generally recognized in building codes and design formulas as approximately the angle along which compressive loads are distributed with substantially no danger of failure in shear. Thus, when the load 40 (FIG. 5) of the leg unit is applied within the 45° shear plane 42, or in other words when the load is closer to the column 20 than the thickness dimension T of the previously-formed floor 12, then the load will be transferred through the floor to the column 20 with the concrete of the floor 12 being loaded substantially only in compression. Concrete is relatively weak in shear and tension loading, but is very strong is compression loading even when the concrete is only partially hardened. By applying the load 40 of each leg unit so that it is transferred substantially solely by compressive loading through the floor 12 and from thence to the column 20, it is possible to apply very large forces without requiring reshoring of the floor 12. The fact that the leg unit 34 merely has to rest upon the floor 12 means that no special brackets or the like have to be installed and later removed and patched over.

The truss assembly 24 includes a truss 50 formed by two frameworks 52, 54 that are braced together by numerous bracing numbers 56. As shown in FIG. 1, each end of a framework 52, 54 is supported by one of the leg units, with the leg units 30, 32 supporting opposite end portions of the framework 52 and the leg units 34, 36 supporting opposite end portions of the framework 54. Each framework such as 54 includes an upper beam 60 at the top of the framework, a lower beam 62 at the bottom of the framework, and numerous strut members 64 that connect the upper and lower beams.

Figure 2:
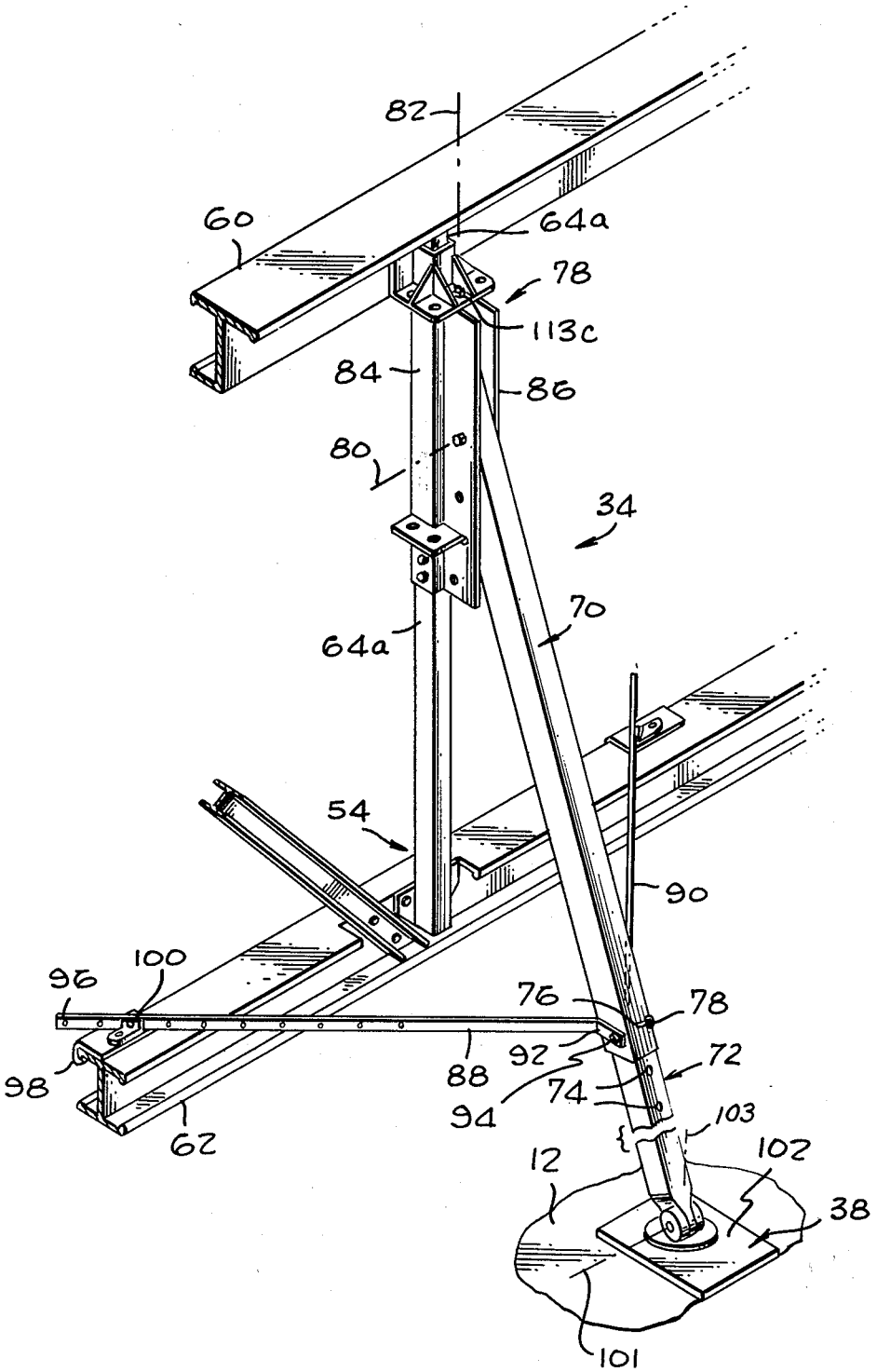
FIG. 2 is a partial perspective view of the truss assembly of FIG. 1, showing the construction of a leg unit thereof with the leg unit in a configuration wherein it extends only to the side.

Each leg unit, such as 34, has the construction best illustrated in FIG. 2. The leg unit 34 includes an upper leg member 70 which is connected to the truss and a lower leg member 72 that extends from the upper leg member to the previously-formed concrete floor 12. The upper leg member 70 is hollow, while the lower leg member 72 is designed to slide or telescope into the upper member to permit adjustment of the length of the leg unit. The lower leg member 72 has numerous holes 74 spaced therealong, while the upper leg member has a hole 76 that can receive a locking pin 77 to fix the position of the leg units.

The upper end of the upper leg unit 70 is pivotally connected by a connector 78 to the upper portion of the framework, at the upper end of a vertical strut member 64a which connects to the upper beam 60. The coupling 78 forms a universal pivot, permitting the leg unit to pivot about two axes 80, 82 so as to enable the lower end 38 of the leg unit to be positioned adjacent to a column. The coupling 78 includes a first bracket 84 fixed to the upper end of the strut 64a of the framework, and a second bracket 86 pivotally connected to the first bracket 84 and pivotally connected to the upper end of the upper leg member 70. The lower end of the upper leg member 70 is braced by a pair of bracing members or struts 88, 90 which extend substantially in a horizontal direction from the bottom of the upper leg member to the bottom of the framework 54 at the lower beam 62 thereof. Each bracing strut such as 88 has one end 92 connected by a bolt 94 to the leg member and has an opposite end 96. The strut end 96 is connected by a bracket 98 to the lower beam 62 of the framework, the bracket 98 being adjustable in position along beam 62. A connector 100 is fixed to the strut 88 and is pivotally mounted on the bracket 98. The strut has a series of holes along its rearward end 96 to enable adjustment of the effective length of the strut and therefore to permit the leg unit to be held at a variety of pivotal positions. The other strut 90 which also ties the lower end of the upper leg member 70 to the bottom of the framework, is similarly constructed and is similarly connected at its opposite ends to the leg unit and to the lower beam 62. The lower end 38 of the leg unit includes a base plate 102 pivotally mounted to the lower end of the lower leg member 72, in a universal pivot connection that permits pivoting about two axes 101 and 103, to better distribute the load to the concrete floor.

Figure 4:
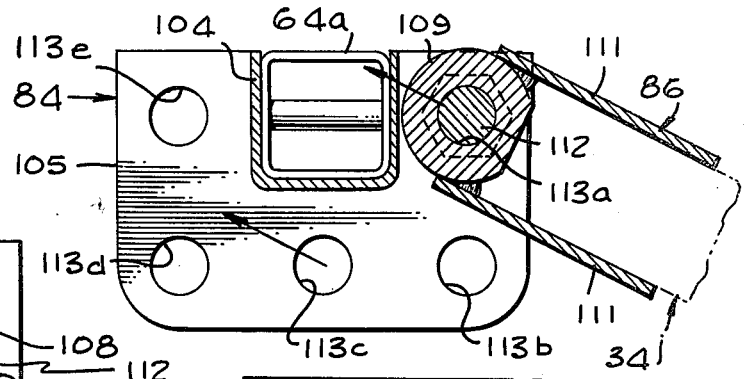
FIG. 4 is a sectional view taken on the line 4—4 of FIG. 3.
Figure 3:
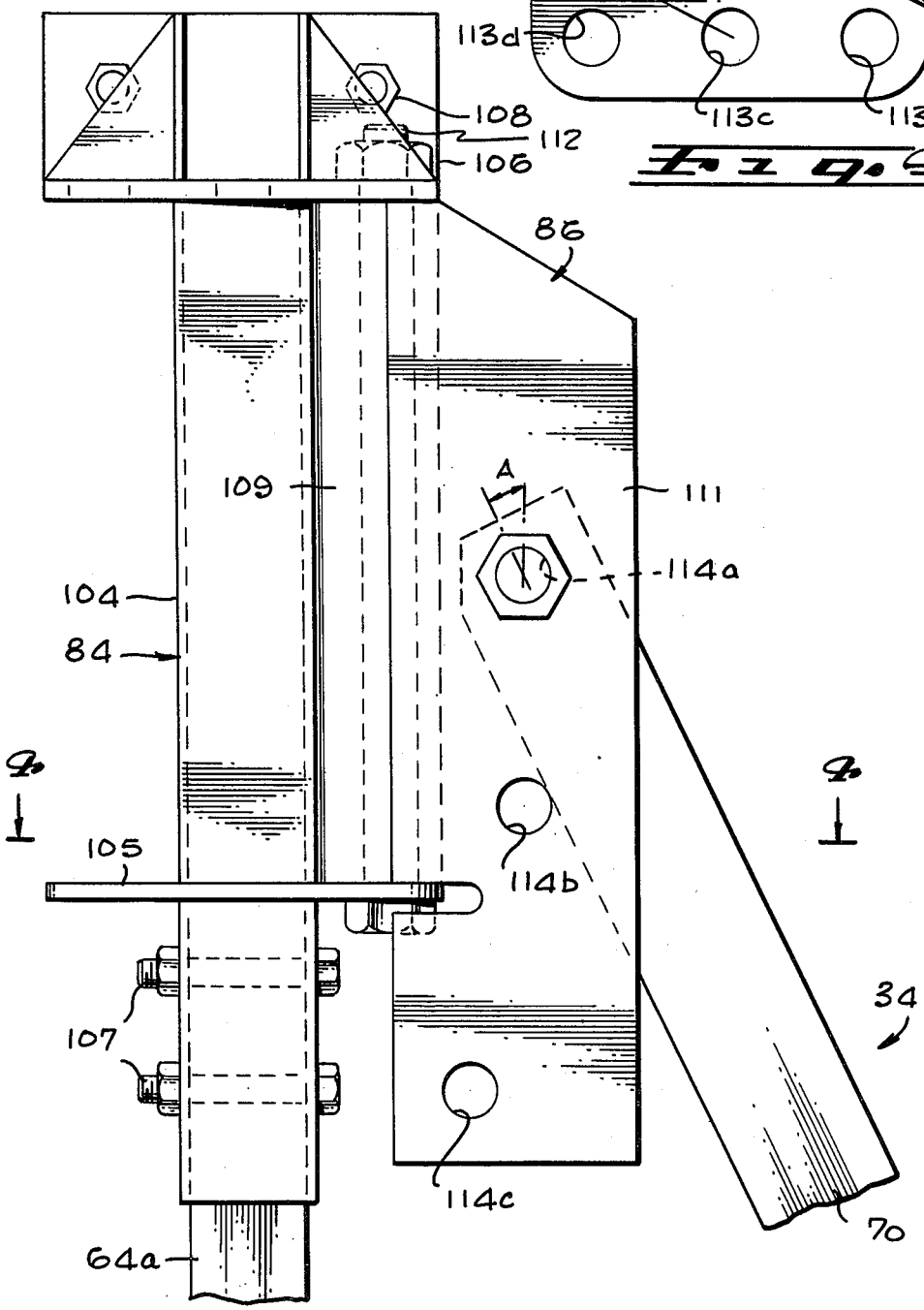
FIG. 3 is a side elevation view of the leg unit of FIG. 2 in one alternate configuration wherein it extends forwardly as well as to the side.

The coupling 78 which connects the upper end of the leg unit 34 to the upper portion of the truss, is designed to permit a wide range of orientations of the leg unit. As shown in FIGS. 2, 3, and 4, the first bracket 84 has a channel member 104 that closely extends about three sides of the vertical truss strut **64*a*. A lower flange 105 is welded to the lower end of the channel member, while an upper flange 106 is welded to the upper end of the channel member. A pair of bolts 107 fasten the lower end of the channel member to the strut 64*a*, while another pair of bolts 108 fasten the upper flange 106 to the upper beam 60 of the truss. The second bracket 86 has a thick tubular center part 109 and a pair of side plates 111 welded to the center part. A large bolt 112 extends through the tubular center part 109 of the second bracket, and through holes in the flanges 105, 106** of the first bracket, to pivotally connect them.

Each of the flanges 105, 106 of the first bracket has a series of five holes **113*a* through 113*e*, and the bolt 112 can be projected through any of these holes. When the leg unit 34 must extend only sidewardly, as illustrated in FIG. 2, then the second bracket 86 is mounted at the middle holes 113*c*. However, when the leg unit must extend in a primarily forward direction, as illustrated in FIGS. 3 and 4, then it is desirable to mount the second bracket at the holes 113*a*. It is possible to merely turn the second bracket 86 so it extends in almost any direction from the center holes 113*c*, but this can lead to twisting of the vertical truss strut 64*a*. For example, if the leg unit 34 must extend in a primarily forward direction as shown in FIGS. 3 and 4, and if the second bracket were mounted at the center hole 113*c* instead of at 113*a*, then there would be a large torque applied to the strut 64*a* tending to twist it. By instead mounting the second bracket at the hole 113*a*, the large compressive load carried by the leg unit produces little if any twisting of the strut 64*a*.**

The side plates 111 of the second bracket 86 have three vertically spaced holes 114*a*, 114*b* and 114*c*. The upper leg 70 of the leg unit is received between the plates, and a bolt 115 which projects through the leg and a pair of holes pivotally connects the leg to the second bracket. The provision of three sets of holes 114*a*, 114*b*, 114*c* permits a mounting location to be chosen which will direct the load through the top of the coupling and avoid the application of large bending forces to the truss strut 64*a*. If the leg unit extends at a large angle A (FIG. 3) from the vertical, then the upper holes 114*a* are utilized. However, it the angle A is very small, then the bottommost holes 114*c* are used. It should be noted that while the coupling enables pivoting about two axes 80, 82, such pivoting can occur only during set up and not after all bolts are tightened and the struts 88, 90 are fastened in position.

The truss 50 of the truss assembly (FIG. 1) is typically constructed with a length, as measured along the length of the upper and lower beams 60, 62 thereof, equal to the lengthwise spacing of the columns, such as between columns 16 and 18. The width W (FIG. 3) of the truss is smaller than the lateral spacing C of the columns, which is equal to the width of the bay to be formed. The truss assembly 24 is utilized by positioning it between the set of columns 16–22 of the building over the previously-cast floor 12. The stringers 26 are usually previously attached to the top of the truss to extend laterally thereon. The leg units, such as 34, are then telescoped out and pivoted to positions which locate their lower ends 38 adjacent to corresponding columns of the building, while they hold the top of the truss 50 at the desired height. The fact that the upper ends of the leg units are coupled to the upper end of the truss, means that the leg units extend at only a moderate angle away from the vertical, so that the leg units are loaded primarily in compression rather than in bending. After the leg units are positioned, the concrete forms 28 are placed on top of the stringers.

The truss 50 is designed so that its width W is not only less than the column spacing C but is also less than the spacing I between the inner faces of the columns. One reason is that this provides clearance for movement of the truss assembly as a unit onto the floor and later out of it. Also, this permits the stringers 26 to extend beyond either side of the truss, in a cantilever mode. If the stringers do not cantilever sufficiently beyond the width of the truss, then the points at which the stringers are supported will be spaced by a greater distance than the optimum, and stringers of larger cross-section will be required. Thus, the leg units such as 34 normally extend at a slant angle in order that their lower ends 38 can reach a floor region adjacent to a column. It also may be noted that the upper ends of the leg units, at the pivotal couplings 78, are spaced a distance S (FIG. 1) from an end of the corresponding framework. This permits the ends of the frameworks to be cantilevered beyond the support points where they are supported on the leg units, which allows the frameworks to be constructed with smaller and therefore lighter beams. The distance S is preferably about 22%, or in other words about one-fifth the entire length of the truss in order to minimize bending stresses and deflection. The fact that the couplings 78 are spaced from the ends of the truss, means that the leg units often must be angled to extend towards the ends of the truss in order that the lower ends 38 may lie adjacent to a column. The universal pivotal coupling 78 permits this wide range of leg unit movement.

After concrete has been cast to product the next higher floor 110, as shown in FIG. 4, the truss assembly 24 can be compacted and moved, as a unit and usually with the stringers 26 thereon, to another location in the building to form another floor portion. Such compacting is accomplished by telescoping in the lower leg member 72 of each leg unit, which not only decreases the height of the truss assembly to permit it to be dropped, but which also moves the lower ends 38 of the leg units inwardly so that they can clear the columns. Additional clearance is obtained by readjusting the bracing struts 88 to permit the leg units to be pivoted more towards the vertical, or in other words, closer against the truss 50. The compacted truss assembly then may be moved on rollers 120 along the floor and then out of the building. The rollers 120 may be attached by legs 122 to the lower beams of the truss assembly, or stationary rollers may be utilized with the truss assembly being rolled along its lower beams along such rollers, all in a well known manner. The fact that the entire truss and leg units can be moved as a single unit to a new location means that a minimum of labor is required to move separate parts and to reattach them at each location. Instead, all parts of the truss assembly move together and the assembly can be set up in a minimum of time. At different locations in the building, there may be some variation in the lateral and longitudinal spacings of the columns as well as the height of the floors. However, the leg units permit adjustments to accommodate different column spacings and floor heights within a substantial range. It also may be noted that in some buildings, the walls may be utilized as the column means that supports the weight of the floors, instead of utilizing only separate columns.

Thus, the invention provides a method and apparatus for shoring concrete forms in a multi-story building, utilizing a minimum of labor. This is accomplished by employing a truss assembly that can be moved as a unit to different locations, wherein the truss assembly includes leg units that can be positioned to lie on areas of the previously-formed floor that are adjacent to columns of the building, and particularly within the 45° shear plane around each column. The leg units support a majority of the weight of the truss 50 and the load carried by the truss, and usually only four leg units are employed to do this. It is possible to also provide one or more vertical legs to support some of the weight of the truss and its load on the previously formed floor at positions spaced far from the columns, but no more than a small fraction of the load should be transferred through such legs to avoid reshoring. It should be noted that some buildings utilize load-bearing walls as the columns or column means that support the weight of the floors, and in those cases the bottom of the leg units are positioned adjacent to such walls.

Although particular embodiments of the invention have been described and illustrated herein, it is recognized that modifications and equivalents may readily occur to those skilled in the art and consequently, it is intended that the claims be interpreted to cover such modifications and equivalents.

The embodiments of the invention in which an exclusive property or privilege is claimed are defined as follows:

1. A concrete forming system comprising:

a partially completed multi-story building having at least a first concrete floor lying at a height of at least several feet above the ground, and having at least two pairs of laterally spaced columns supporting said floor above the ground and extending at least several feet above the level of said floor;

a truss lying at a distance above said floor, said truss having a pair of laterally spaced frameworks connected together by a plurality of bracing members, each framework including upper and lower beams and struts joining said beams, said frameworks being laterally spaced by less than the lateral spacing of said pairs of columns and lying between said pairs of columns;

floor-forming form means supported on said truss assembly, for forming a portion of a floor above said first floor; and support means for supporting the weight of said truss and any load thereon, including four diagonal leg units, each of said leg units having an upper end coupled to a corresponding one of said frameworks at one end portion thereof and a lower end resting on said first floor;

said leg units extending diagonally from a framework to the first floor, and the lower end of each leg unit lying adjacent to one of said columns and with at least part of the lower end lying within the 45° shear plane area around the column, said four diagonal leg units supporting a majority of the weight of said truss and any load thereon.

2. The system described in claim 1 wherein:

each leg unit includes a hollow upper leg member and a lower leg member slideably received in said upper leg member and fixable in position therealong, the upper end of the upper leg member being connected to the top portion of a framework in an adjustable joint that permits adjustment of the orientation of the upper leg member, and including at least one leg-bracing strut extending between a lower end of the upper leg member and the lower portion of the same framework to fix the orientation of the leg unit.

3. Apparatus which is useful in supporting concrete forms above an already-formed concrete floor in a building that has columns or the like that support the weight of floors of the building comprising:

a truss including a pair of parallel frameworks and bracing members connecting the frameworks together, each framework having upper and lower beams and strut members joining the beams; and four leg units, each positioned at a different end portion of a different framework, each leg unit having an upper leg, a connector coupling the top of the upper leg to an upper portion of a corresponding framework, and a lower leg having an upper portion coupled to and longitudinally adjustably positionable with respect to the upper leg and having bearing plate means at the lower end, said connector being constructed to permit adjustment of the angular orientation of said upper leg about both a longitudinal axis extending parallel to the length of the truss and a vertical axis which extends vertically, whereby to enable the weight of the truss assembly and the load of forms and poured concrete thereon to be transferred to floor regions adjacent to the columns.

4. The apparatus described in claim 3 wherein:

the point at which the upper end of each leg unit is coupled to a framework is spaced from the extreme end of the framework by a distance of approximately one-fifth the entire length of the framework.

5. Apparatus which is useful in supporting concrete forms above an already-formed concrete floor in a building that has columns or the like that support the weight of floors of the building, comprising:

a truss including upper and lower beams (60, 62) and vertical strut members (64*a*) joining the beams;

a plurality of leg units, each having upper and lower legs (70, 72) that can telescope into one another to adjust the effective length of the leg unit, and each having a bearing plate (102) at the lower end of the lower leg for resting on the already-formed floor; and a plurality of couplings (78) for connecting the upper ends of the leg units to said truss, each coupling including a first bracket (84) mounted on said truss and a second bracket (86) mounted on said first bracket and connected to the upper end of an upper leg of one of said leg units;

said first bracket including a channel member (104) closely surrounding one of said vertical struts (64*a*), and lower and upper flanges (105, 106) at opposite end portions of the channel member, each flange having a plurality of holes (113) spaced about said channel member;

said second bracket including a vertical member (109) extending between said lower and upper flanges and fastened to each flange at a selected one of said holes therein, and a pair of parallel plate members (111) fixed to said vertical member, each of said plate members having a plurality of vertically spaced holes (114), and the upper end of one of said upper legs (70) fastened to said plates at a selected one of said holes, whereby to enable mounting of the second bracket on the first one and the mounting of the upper leg on the second bracket so that there is minimal twisting or bending of the vertical strut member of the truss for a wide range of orientations of the leg unit.

6. A method for forming a next higher concrete floor above an already-formed concrete floor, in a building that has a plurality of spaced columns that support the already-formed floor above the ground, comprising:

positioning a truss assembly that contains a truss and four extensible leg units spaced about the truss and pivotally connected to it, between a group of said columns and above said already-formed floor;

pivoting and extending said leg units so that the lower end of each leg unit rests on an area of said already-formed floor adjacent to one of said columns and with the middle of the leg unit bottom located within the 45° shear plane about the column, and supporting the weight of the truss and any load thereon including supporting a majority of the weight of the truss and any load thereon through said four leg units to said floor areas around said columns; and mounting forms on said truss and pouring concrete onto said forms, whereby most of the weight of the forms and concrete is carried through said truss and leg units to floor areas within the shear plane and thus by compressive loading of the already-formed floor to the columns.

7. Apparatus which is useful in supporting concrete forms above an already-formed concrete floor in a building that has columns or the like that support the weight of floors of the building, comprising:

a truss including a pair of parallel frameworks and bracing members connecting the frameworks together, each framework having upper and lower beams and strut members joining the beams; and four leg units, each positioned at a different end portion of a different framework, each leg unit having an upper leg, a connector pivotally coupling the top of the upper leg to an upper portion of a corresponding framework, at least one strut of adjustable effective length extending between the bottom of the upper leg and a lower portion of the framework to fix the pivotal angle of the upper leg, a lower leg having an upper portion coupled to and longitudinally positionable with respect to the upper leg and having bearing plate means at the lower end said connector which pivotally couples the top of the upper leg to an upper portion of a corresponding framework including a first bracket mounted on a strut member of one of said frameworks, and a second bracket mounted on said first bracket and connected to an upper leg of a leg unit;

said first bracket having a plurality of mounting portions spaced about said strut member on which the first bracket is mounted, and said second bracket being mountable at any of said mounting portions, whereby to permit a mounting position to be chosen that will minimize twisting of the strut for a range of orientations of the leg unit.

8. A concrete forming system comprising:

a partially completed multi-story building having at least a first concrete floor lying at a height of at least several feet above the ground, and having at least two pairs of laterally spaced columns supporting said floor above the ground and extending at least several feet above the level of said floor;

a truss lying at a distance above said floor, said truss having a pair of laterally spaced frameworks connected together by a plurality of bracing members, each framework including upper and lower beams and struts joining said beams, said frameworks being laterally spaced by less than the lateral spacing of said pairs of columns and lying between said pairs of columns;

floor-forming form means supported on said truss assembly, for forming a portion of a floor above said first floor; and support means for supporting the weight of said truss and any load thereon, including four diagonal leg units, each of said leg units having an upper end coupled to a corresponding one of said frameworks at one end portion thereof and a lower end resting on said first floor;

said leg units extending diagonally from a framework to the first floor, and the lower end of each leg unit lying adjacent to one of said columns and with at least part of the lower end lying within the 45° shear plane area around the column, said four diagonal leg units supporting the weight of said truss and any load thereon.

9. The system described in claim 8 wherein:

each leg unit includes a hollow upper leg member and a lower leg member slideably received in said upper leg member and fixable in position therealong, the upper end of the upper leg member being connected to the top portion of a framework in an adjustable joint that permits adjustment of the orientation of the upper leg member, and including at least one leg-bracing strut extending between a lower end of the upper leg member and the lower portion of the same framework to fix the orientation of the leg unit.

10. A method for forming a next higher concrete floor above an already-formed concrete floor, in a building that has a plurality of spaced columns that support the already-formed floor above the ground, comprising:

positioning a truss assembly that contains a truss and four extensible leg units spaced about the truss and pivotally connected to it, between a group of said columns and above said already-formed floor;

pivoting and extending said leg units so that the lower end of each leg unit rests on an area of said already-formed floor adjacent to one of said columns and with the middle of the leg unit bottom located within the 45° shear plane about the column, and supporting the weight of the truss and any load thereon through said four leg units to said floor areas around said columns; and mounting forms on said truss and pouring concrete onto said forms, whereby the weight of the forms and concrete is carried through said truss and leg units to floor areas within the shear plane and thus by compressive loading of the already-formed floor to the columns.

* * * * *